US010487993B2

(12) United States Patent
McRae

(10) Patent No.: US 10,487,993 B2
(45) Date of Patent: Nov. 26, 2019

(54) LIGHTED ORNAMENTS

(71) Applicant: Michael M McRae, Ormond Beach, FL (US)

(72) Inventor: Michael M McRae, Ormond Beach, FL (US)

( * ) Notice: Subject to any disclaimer, the term of this patent is extended or adjusted under 35 U.S.C. 154(b) by 0 days.

(21) Appl. No.: 14/120,743

(22) Filed: Jun. 23, 2014

(65) Prior Publication Data

US 2015/0103524 A1 Apr. 16, 2015

Related U.S. Application Data

(60) Provisional application No. 61/957,011, filed on Jun. 21, 2013.

(51) Int. Cl.

| | |
|---|---|
| ***F21S 4/10*** | (2016.01) |
| *F21W 121/04* | (2006.01) |
| *A47G 33/08* | (2006.01) |

(52) U.S. Cl.

CPC ..... *F21S 4/10* (2016.01); *A47G 2033/0827* (2013.01); *F21W 2121/04* (2013.01)

(58) Field of Classification Search

CPC ..... F21W 2121/04; F21S 4/001; F21S 4/10; A47G 33/08; A47G 2033/0827

See application file for complete search history.

(56) References Cited

U.S. PATENT DOCUMENTS

| | | | | |
|---|---|---|---|---|
| 2,608,779 | A * | 9/1952 | Joy | F21S 10/00 362/809 |
| 4,425,602 | A * | 1/1984 | Lansing | A45B 3/04 362/102 |
| 4,452,836 | A * | 6/1984 | Daniel, Jr. | A47G 33/10 106/437 |
| 4,974,128 | A * | 11/1990 | Prickett | F21V 21/08 362/145 |
| 5,876,111 | A * | 3/1999 | Wu | F21S 4/10 362/249.16 |
| 2006/0164831 | A1* | 7/2006 | Lai | F21S 10/023 362/231 |
| 2007/0070627 | A1* | 3/2007 | Richmond | A47G 33/08 362/249.01 |

(Continued)

*Primary Examiner* — Anh T Mai
*Assistant Examiner* — Steven Y Horikoshi
(74) *Attorney, Agent, or Firm* — Ellenoff Grossman & Schole LLP; James Smedley; Alex Korona

(57) ABSTRACT

An illuminated ornament is provided having an internally disposed support structure for mounting lighting elements within the ornament. In one aspect, the structure is a rod, hub and spoke arrangement in which the rod extends along an axis of the ornament with lighting elements being disposed at numerous locations along the axial positions on the rod and radial positions on the spokes. In another aspect, the ornament is divided into separate illuminated segments, each having its own lighting elements placed appropriately within each segment. In any arrangement, the goal of uniform ornament illumination and overall ornament color control is provided by proper placement of the LEDs on the support structures, possibly in combination with coloration of the ornament shell, color enhancement apparatus contained on the shell and/or in combination with external, electronic controlled access to the color display of the LEDs.

8 Claims, 21 Drawing Sheets

(56) References Cited

U.S. PATENT DOCUMENTS

2008/0192488 A1* 8/2008 Lai ..... A47G 33/08
362/362
2008/0274641 A1* 11/2008 Weber ..... F21V 23/06
439/541.5

* cited by examiner

LIGHTED ORNAMENTS

CROSS REFERENCE TO RELATED APPLICATIONS

This application claims priority to and the benefit of U.S. Provisional Patent Application No. 61/957,011 filed Jun. 21, 2013 titled "LIGHTED ORNAMENTS" the contents of which are incorporated by reference herein in their entirety.

STATEMENT REGARDING FEDERALLY SPONSORED RESEARCH OR DEVELOPMENT

Not applicable.

BACKGROUND OF THE INVENTION

1. Field of the Invention

The invention discloses a number of lighted ornament arrangements. These lighted ornaments are primarily intended for use within an LED light string system. In particular, LED lighting elements are provided within the ornaments themselves such that the ornaments appear to be illuminated. The ornament bulbs themselves may contain single color LEDs and/or multicolor LEDs. Highly configurable mechanical mounting elements are combined and coupled to one another, and mounted within the ornaments as a support structure on which illumination elements may be mountably affixed. These mechanical mounting elements may be further designed as being configurable parts so that the same parts may be manufactured en masse and used in many different illuminated ornaments of different sizes and shapes. As a consequence of the constructions provided within these ornament structures, various signaling patterns may be applied over signal control wires coupled to the lighting elements within the ornaments so as to create dynamic display patterns within the ornaments.

Description of the Prior Art

U.S. Pat. No. 5,772,312, Issued Jun. 30, 1998 to Pihl-Niederman et al. (hereinafter "Pihl-Neiderman et al.") discloses a lighted holiday ornament for housing a portion of a holiday light string. (Abstract.) A hollow shell is provided in which a light string enters and exists the shell through apertures formed on the shell exterior. Since only a portion of the light string is contained within the shell, the portions of the light string not contained within the shell are available for external connection to power sources and other light strings outside the shell. The shell consists of two shell halves connected by a hinge such that access to the shell inside is provided for securing the light string. (Col. 2, 11. 21-39.) Hook mechanisms are contained on the interior surface of the shell for securing the light string portions within the shell in a fixed relationship to the shell exterior. (Col. 4, 11. 1-14.) Optionally, translucent members are secured to the shell exterior to enhance the optical characteristics of the light emanating from the shell. (Abstract.) Neither Pihl-Niederman et al. nor any other related prior art, discloses an apparatus for mounting modern LED structures for use within a lighted ornament.

Thus it is an object of this invention, and the failure of the prior art to-date, to provide for the simple construction of a lighted ornament that securely houses the LEDs used in modern day holiday decorations. It is highly desirable to provide a relatively cheap lighted holiday ornament that possesses sufficient structural strength and configurable mechanisms for housing modern LED technologies while also presenting a pleasing visual lighted display of the ornament color and shading.

BRIEF SUMMARY OF THE INVENTION

In a particularly preferred embodiment of the invention, an ornament is provided that includes: a shell having an inner and outer surface, at least two support receptacles disposed on the inner shell surface, a support column having end portions sized to fit within the receptacles, the end portions inserted into the receptacles such that the support column is mountably engaged in a fixed position within the ornament, the support column having mounting brackets for mounting lighting elements within the ornaments, the lighting elements coupled to each other and to a wiring harness, the wiring harness extending at least to the outer surface of the shell. In one aspect of this invention the support column includes secondary supports, the secondary supports also including the mounting brackets for mounting lighting elements.

In another particularly preferred embodiment, an ornament is provided that includes a shell having an inner and outer surface, at least two segment bases each having at least two sides and a segment separator, the segment bases coupled to the segment dividers on each side of the segment, at least one segment base coupled to at least one lighting element, the lighting element electrically coupled to a wire harness, the wiring harness extending at least to the outer surface of the shell. In one aspect of this invention each segment is coupled to a lighting element, and each of the lighting elements contains at least two LEDs having different colors.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
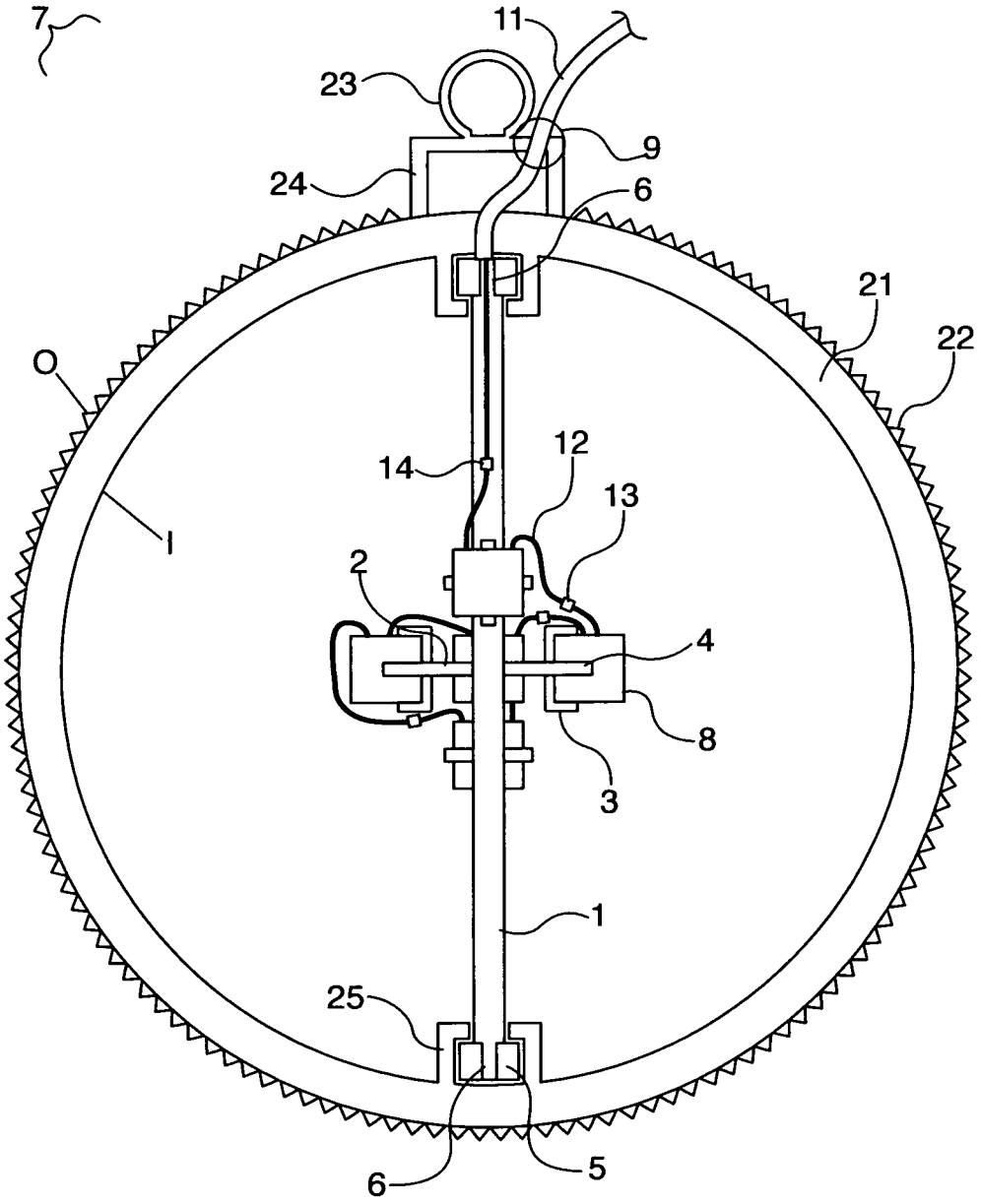
FIG. 1 shows cutaway side view of a lighted ornament according to one embodiment of the present invention.

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that certain aspects of the present invention may be implemented in various forms of hardware, software, firmware, special purpose processors, or a combination thereof. Preferably, certain aspects of the present invention may be implemented in software as a program tangibly embodied on a program storage device. The program may be uploaded to, and executed by, an electronic machine comprising any suitable architecture. Preferably, certain aspects of the invention are implemented on a computer platform having hardware such as one or more central processing units (CPU), a random access memory (RAM), and input/output (I/O) interface(s). The computer platform may also include an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

It is to be understood that, because some of the constituent system components and method steps depicted in the accompanying figures are preferably implemented in software, the actual connections between the system components (or the process steps) may differ depending upon the manner in which the present invention is programmed. Specifically, any of the computers or devices may be interconnected using any existing or later-discovered networking technology and may also all be connected through a lager network system, such as a corporate network, metropolitan network or a global network, such as the internet.

A light string of LED lights typically includes multiplicity of LED bulbs powered by DC current. The number of light bulbs on each leg of the light string can be as few as two and up to as many as the applied DC voltage and safe current draw allows. Typically, anywhere between 3-10 LEDs are included on each leg of an LED light string. Individual light strings may be connected in series, such that a large number of lights formed by several strings are created with associated lights being connected thereto, and/or each light string may consist of a number of parallel lighted sub-strings. Regardless of the light string configuration, the operating DC bias voltage of the lighting system must be monitored to safely maintain power to the entire light string. To date, light strings have been used primarily as a means to facilitate the display of single LED bulbs, or clusters of blubs, disposed along the length of the string. As holiday lighting patterns become more complex, it is desirable to extend the display capability of such LED light strings to include ornaments or other configurable illuminated decorations that can be attached to the LED light strings. In particular, holiday decorations such as an illuminated angel or a star on a Christmas tree are candidates for inclusion within the LED light strings as otherwise being provided on the tree for illuminated display.

The present invention discloses a number of different structural embodiments for accomplishing the mounting of the LEDs within casings or shells (ornaments). The LEDs disposed within the shell may be all of a single color, dual colored, multi colored or any combination thereof. They may be attached to support rods (configured in branch-like structures within the shell), or they may be disposed on plastic trays, printed circuit boards or other mounting structures affixed to support points within the ornament. The lighted ornaments of the present invention may also be used in connection with other technologies developed by the inventor. In particular, the ornaments may be used in connection with U.S. Pat. No. 7,591,658 to illuminate the ornament in a follow-on mode according to a lighting pattern provided on a preceding light string. U.S. patent application Ser. No. 13/694,755 filed Dec. 31, 2012 may be used to provide DC-rectified power to the illuminated ornament. Also, multicolor and highly-pattern specific LED displays may be created and operated within the shell with the assistance of U.S. patent application Ser. No. 13/694,754 filed Dec. 31, 2012. All of these patents and applications are incorporated by reference herein in their entireties and portions of the disclosures within these patents and patent applications may be used in connection with the teachings of the present invention to provide a more full understanding of an overall lighting system that incorporate the present invention(s).

With respect to single and dual color applications, the description below discloses several common and universal centralized structures for mounting a plurality of LEDs within the middle of an enclosed shell. These structures are configurable so as to operate within any number of different ornament shapes and sizes and have an internal placement arrangement of the LEDs in such a manner so as to provide a maximum amount of illumination, for any given ornament shape. A minimal number of similarly designed parts are used to achieve the design objectives of the universal illuminated ornament, and these parts are expected to be configurable after initial manufacture. For example, a single mounting rod or tree may be extruded to the longest design-specified length during the manufacturing possess and then customized, e.g. with break points, such that shorter, sub-portions of the rod may be used in other smaller-dimensioned products. The common portions of the interchangeable parts may also provide common connection locations so that larger more complex support structures may be created through the appropriate selection of rod lengths and ornament connection points used in connection with the same.

In the multi-colored applications of the below-described invention, the LED mounting structures provide a means by which multicolor illumination patterns may be displayed, typically within sections of the shell, using individual multicolor LED ornaments or strings of the same. These ornaments may be configured to operate independently and may be configured to possess the ability to change from an all white display to one of many multi-colors. The invention further provides color enhancements on the ornament shell such as diffusion patterns and colored ornament segments sections. Additionally, with the aid of proper LED bulb control apparatus, the invention also provides for a single ornament or a plurality of ornaments and decorations to be electronically sequenced between a plurality of Holiday color arrangements and/or multiple color combinations so as to provide the appearance of movement of the ornament, either alone or in combination with attached light strings In other aspects, the invention of the present invention is intended to provide for supplemental power to be added to one or more of the LED light strings or LED ornaments while maintaining the color coordination of the entire display. The invention also provides examples of assembly methods for the ornaments using the LED internal supports and methods of segmenting a plurality of ornament shapes to provide a plurality of LED locations, sections and configurations that best suit the particular ornament, while still maintaining simplicity of construction and minimal number of parts.

FIG. 1 shows a cutaway side view of spherical ornament 7 according to one embodiment of the present invention. The ornament consists of shell 21 having inner (I) and outer surfaces (O). Shell 21 may be clear or partially opaque and may also include a jagged diffusion pattern 22 disposed on the outer surface O (or inner surface (I)) thereon to enhance the illumination characteristics of the ornament. Shell 21 may be a singular piece part, but for ease of internal assembly and connection, shell halves are envisioned that snap or otherwise affix to one another to form a complete shell comprising the ornament. Shell 21 contains a hanger cap 24 affixed to the outer surface (O) of the top of the shell. Hanger cap 24 includes hanger 23 for hanging the ornament. Hanger cap 24 also includes an access port 9 that allows individual wires to enter and exit the ornament. These wires are needed to provide power and control signaling to the lighting elements within the ornament and are typically included within a wiring harness 11 that provides for rigid support and insulation of the individual lighting element wires 12 as they enter and exit the ornament.

Within the shell 21, at least one pair of support receptacles or cavities 25 are provided on the inner surface (I) for accepting a mating portion of the lighting support structures within the ornament. As shown in FIG. 1, support member 1 is disposed long the major axis of the ornament 7 and is the primary support structure on which five LEDs 8 are mounted. Although support member 1 is shown as a straight rod extending between opposite one ends of shell 21, alternative geometries are possible to achieve the illumination objects of this invention while providing sufficient structural rigidity to the support. Support 1 includes block-like or bulb-like support locks 5 at its ends. Support locks 5 are configured to fit within support receptacles 25 such that support 1 may be fixably engaged within the ornament via the support lock upon full assembly. Matching and complementary locking keys may be provided within the receptacles 25 and on the support locks 5 of support 1 so that only one connection orientation of the support 1 within the receptacle 25 is possible. Further support lock may contain wiring groove 6 for containing and managing the wires and wire harness entering the shell 21. Support 1 may include secondary supports 2 that are coupled to support 1 at configurable points on the support. Alternatively, the support 1 and secondary supports 2 may be fabricated as a single, congruous unit. Vertical LED mounts 3 and horizontal LED mounts 4 are provided on either or both of the support 1 and secondary support 2 for firmly holding the LEDs 8 in place. In one particularly preferred embodiment, the LEDs are "snapped" into position within mounts 3 and 4.

It should be appreciated that the resultant location of the support and the secondary supports, as well as the placement of LED mounts 3 and 4, determine the overall look and perception of the lighted ornament. In one uniformly lit configuration, support 1 extends along a major axis of shell 21 and the secondary supports are either located uniformly along support 1 or in the center region as shown in FIG. 1. LEDs 8 are disposed evenly in both axial and radial directions within the ornament by mounting them at various radial and axial positions on support 1. Central points of illumination regions within the ornament are most desirable so as to achieve a uniform internal illumination of the ornament. Specific, internal lighting patterns are also possible through selective placement of the supports and LEDs in other locations.

From an electrical connection perspective, wires within wire harness 11 are fed through access port 9 from outside the shell 21 through harness groove 6 on the support locks 5 and down along support 1. Both wiring harness 11 and any LED leads 12 exiting the harness may be affixed along support 1 and secondary supports 2 at connection points 14 so as to mechanically secure them and prevent their movement within the ornament. As LED leads 12 are separated from wiring harness 11, they are individually connected to LEDs 8 to provide electrical connections thereto and LED lead connections 13 are created as needed within the wiring structure to achieve the desired electrical structure to power and control the LEDs. Ideally individual LED leads 12 within the wire harness 11 are separated out for connection to individual LEDs only as the wire harness gets closer to the LEDs so as to maximize the structural integrity of the electrical connections.

Figure 2A:
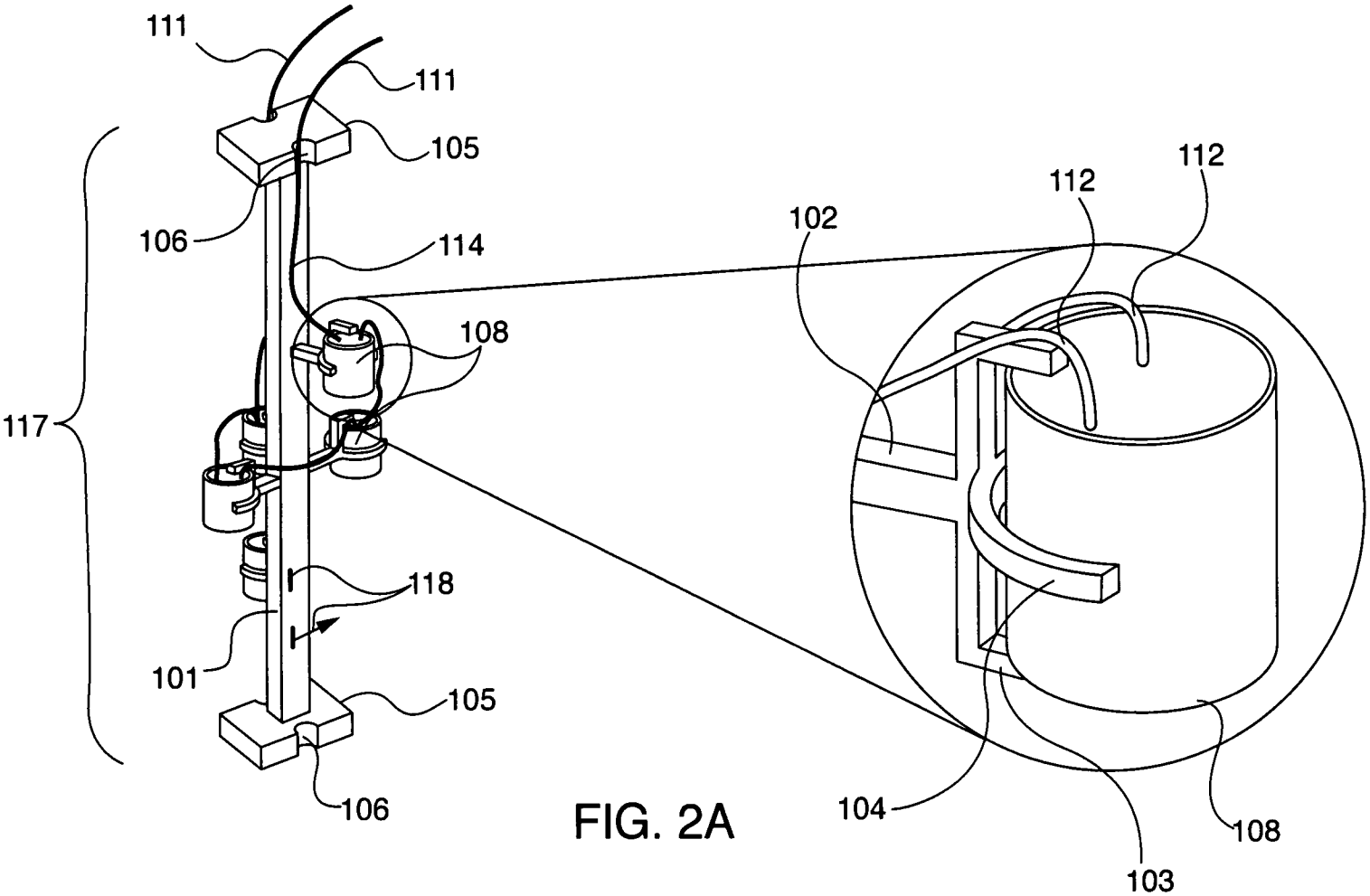
FIGS. 2A-2D show four different embodiments of a subassembly of the inner support structure used within a lighted ornament according to various embodiments of the present invention.

FIG. 2A shows a LED support subassembly 117 of the inner support structures on which the LEDs are mounted. The particular configuration of LED support subassembly 117 shown in FIG. 2A is the same as that used within the lighted ornament according to the embodiment provide in FIG. 1. All elements of FIG. 2A are numbered correspondingly as with those identified in FIG. 1. Of particular note, the harness groove 106 is shown as a semicircular channel cut with support lock 105. Further, a detailed view of the vertical and horizontal mounting structures 103 and 104 are shown as retaining LED 108 which is generally cylindrical in shape. Two LED leads 112 are shown as exiting form the wire harness 111 for connection to LED 8. Finally, engagement slots 118 are provided on support 101. The secondary supports of FIG. 2 are shown as fixed to support 101 in FIG. 2, but additional secondary supports may be accommodated by support 101 as necessary. Engagement pins on additional secondary support 102 may provided at the connection end thereof for insertable engagement into support 101 at engagement slots 118. As mentioned above, other methods of adding additional secondary supports or relocating existing secondary supports may also be accommodated within the present invention. For example, rails may be included along support 101 with the connection end of the secondary supports containing "T" structures that slide within and along the "rails." Any of a number of fixed or flexible arrangements that accommodate the positioning and placement of the LEDs and secondary supports on the support 101 is considered within the scope of the present invention.

Figure 2B:
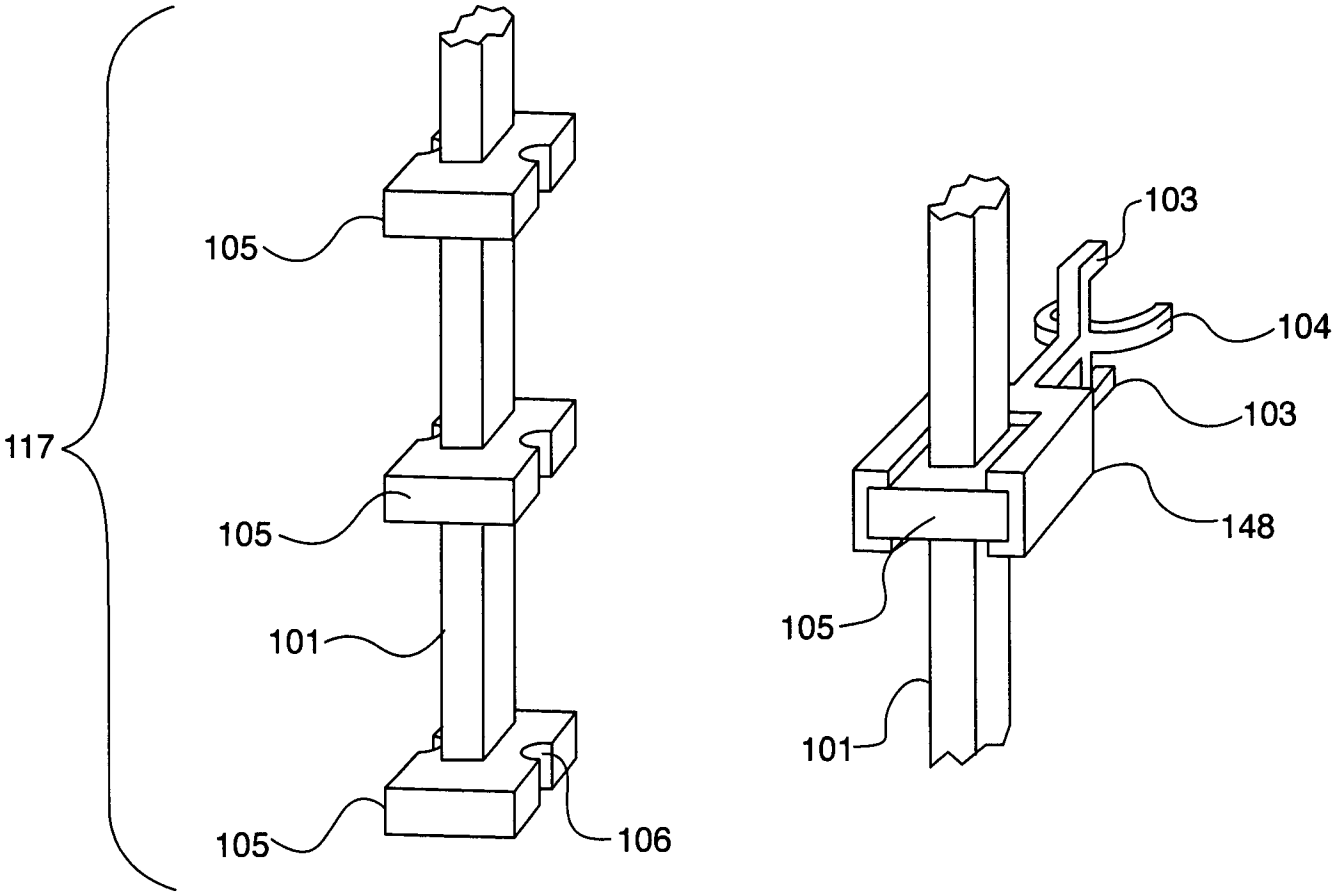
Figure 2D:
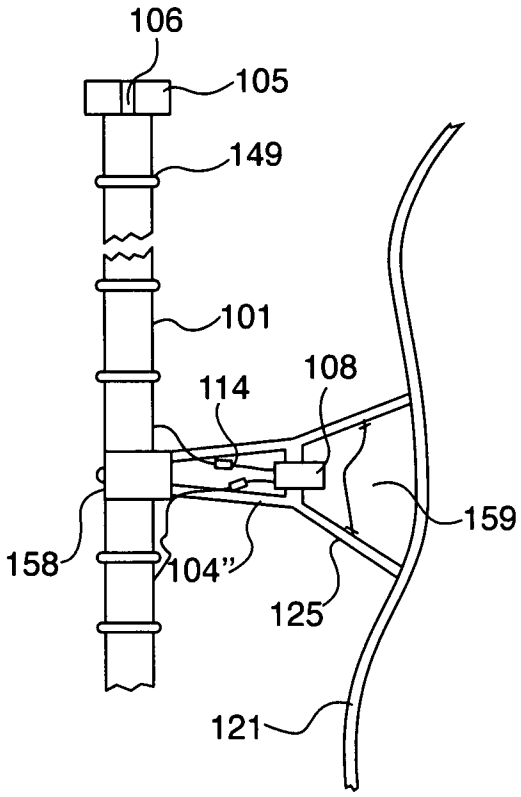
Figure 2C:
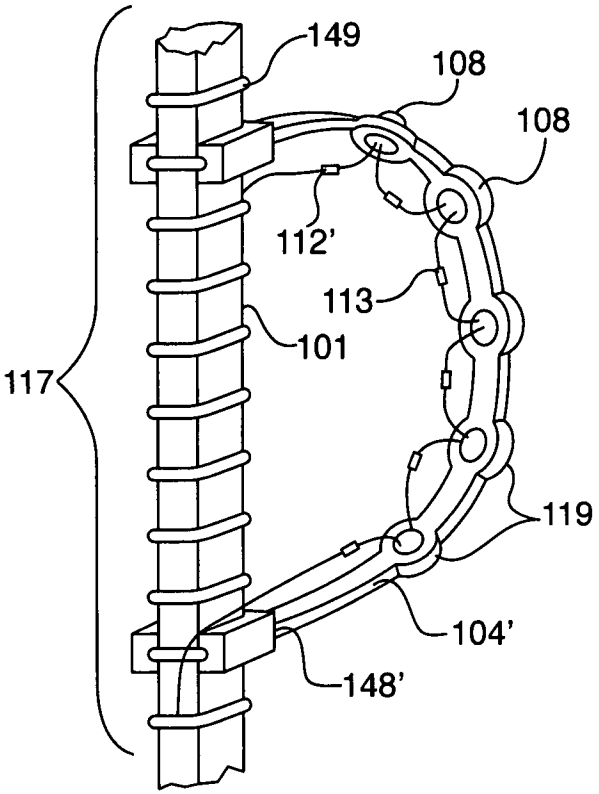

FIGS. 2B-2D illustrate alternative embodiments of the LED support subassembly 117. All elements of FIGS. 2B-D are numbered correspondingly as with those identified in FIGS. 1 and 2A. With reference to FIG. 2B, support subassembly 117 has a series of support locks 105 disposed at numerous points along support 101. Support locks 105 are identical to those for mounting the support in the ornament. The position of the LED mounts along support 1 are configurable through the use of LED mount collars 148 which are coupled to the LED mounts 103 and 104. LED mount collars have one side of the collar exposed which enables them to be slideably engaged over support lock 105 to position the LED mounts at the desired location on support 101. This embodiment is highly useful when singular supports 101 are manufactured and simply "cut to fit" depending on the length needed for any given ornament. LED mounts can then be placed along the support anywhere that is required by the ornament being constructed.

Figure 7:
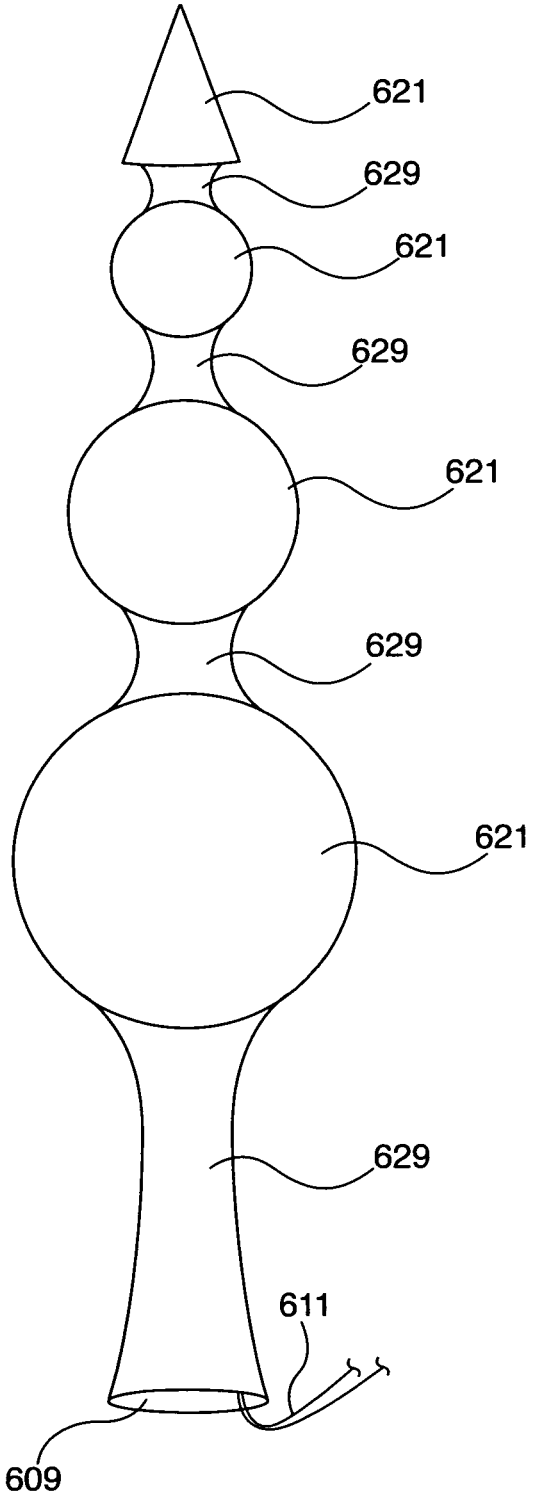
FIG. 7 shows a lighted tree-top ornament according to another embodiment of the present invention.
Figure 8:
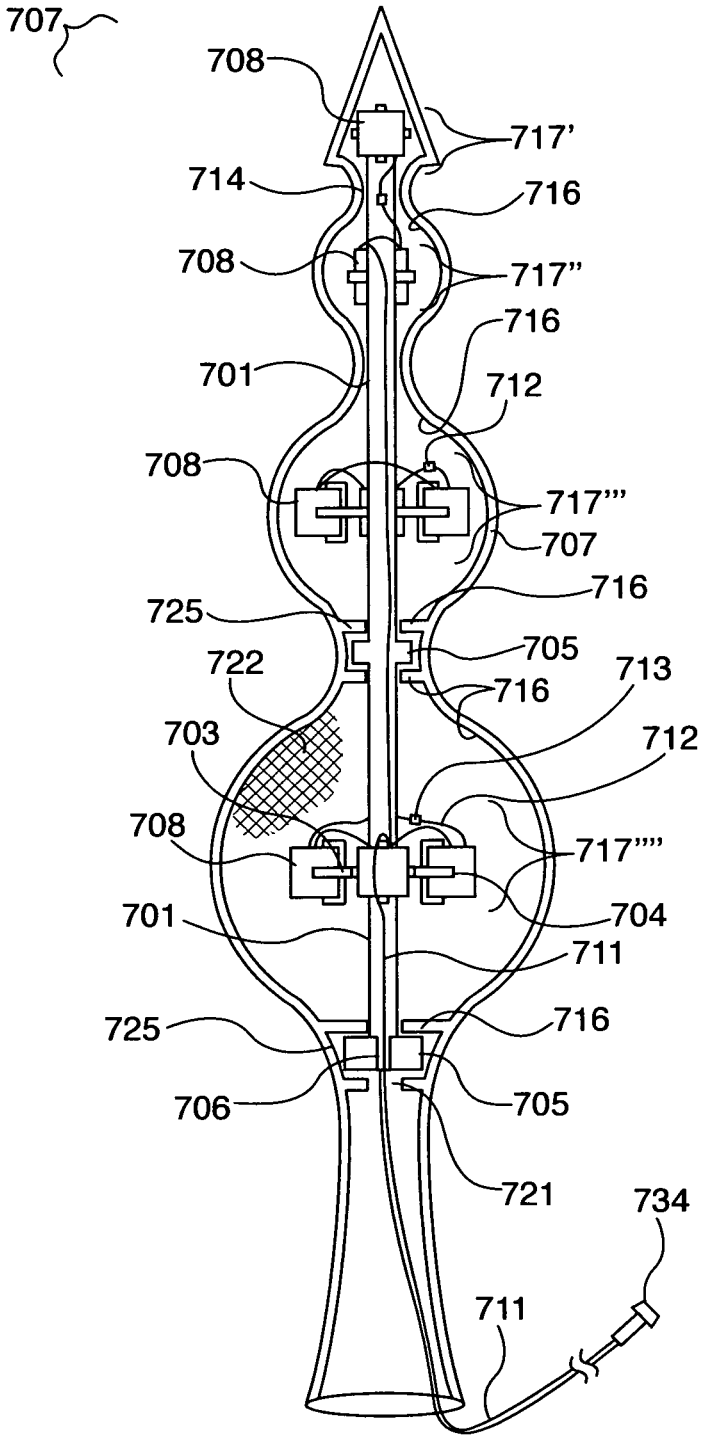
FIG. 8 shows cutaway side view of the ornament of FIG. 7 according to one embodiment of that invention.

With reference to FIG. 2C, support assembly 117 has support 101 containing numerous annular rings 149 along the length of the support. The annular rings are closely spaced along support 101 for fine adjustment of the LED mounts and are different in structure from support locks 105. LED mount collars 148' have one side of the collar exposed which enables them to be slideably engaged over annular rings 149 to position the LED mounts at the desired location on support 101. In the embodiment of FIG. 2C the LED mounts 104' are flexible plastic bands with numerous LED mounting sites 119 in which LEDs 108 are held. Wiring interconnections 113 are provided for joining the wiring 112' which extends to LEDs 108. With the support structure of FIG. 2C, numerous half-loops of LEDs can be created with any of a variety of curvatures, sizes, extension distances, configurable patterns etc. along support 101. This embodiment is particularly advantageous for rounded ornament shapes containing a plurality of different rounded sizes. FIGS. 7 and 8 below provide one example of such an application.

FIG. 2D shows another support assembly 101 having annular rings similar to those of FIG. 2C. In this embodiment, LED mount collars 158 contain LED mount structure 104" that houses LED 108. LED 108 is positioned to provide illumination only within illumination volume 159. Illumination from LED 108 is further contained within region 159 by reflective surfaces 125 which help to direct all illumination out of ornament shell 121 with very little escaping back into the ornament.

Figure 3:
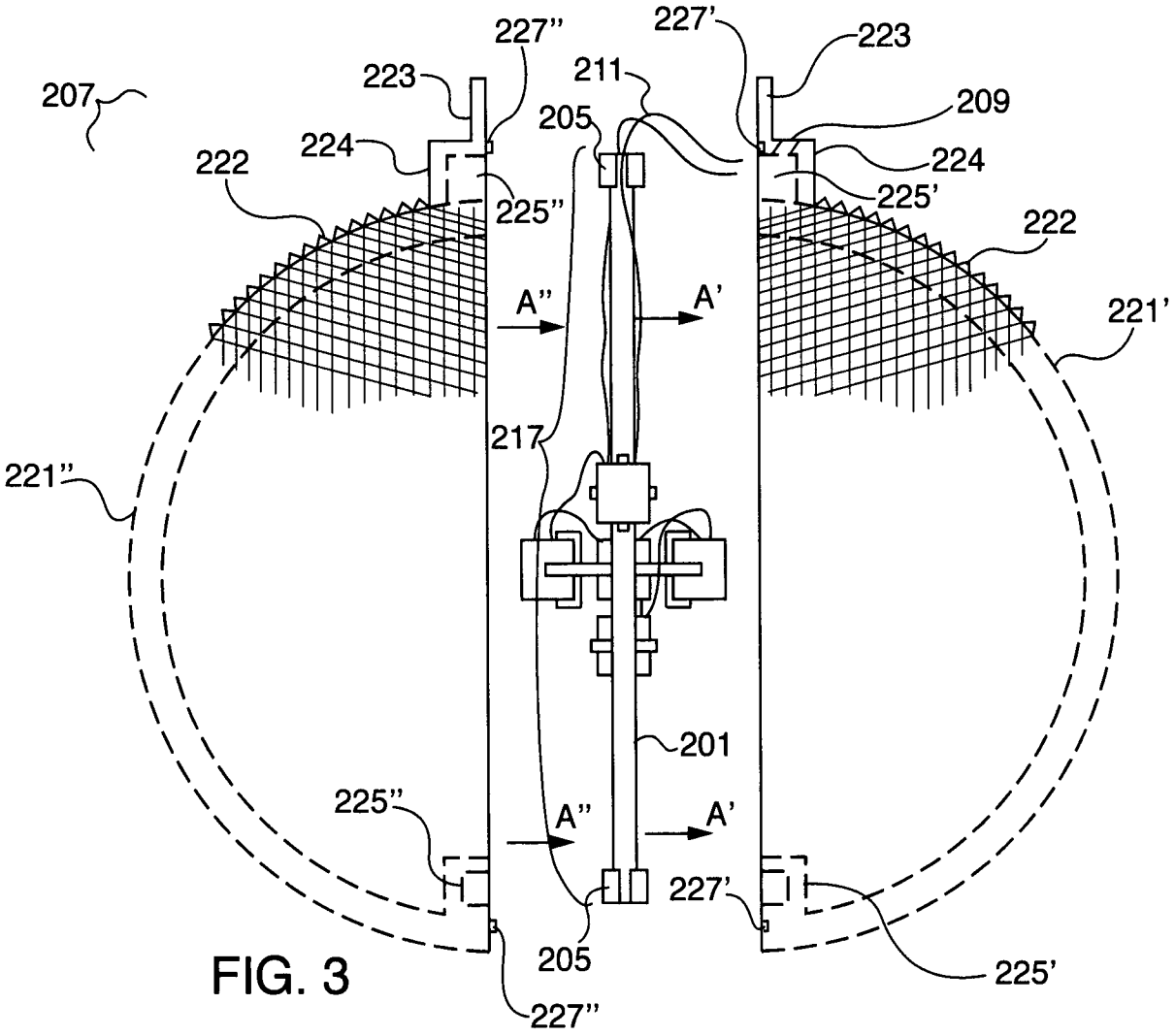
FIG. 3 shows an assembly diagram of an ornament according to one embodiment of the present invention.

FIG. 3 shows an assembly diagram of the spherical ornament of FIG. 1. The two halves of shell 21 are shown as separate parts 221' and 221". Shell half 221" contains pins 227" that are configured for mateable engagement with the holes 227' on shell half 221'. Although a "snap connection" of pins and holes is illustrated, any mechanism may be used to accomplish the fixed connection of the two shell halves. To assemble the ornament, LED support subassembly 217 is moved along the direction of arrows A' such that the support locks 205 are fitted within the support receptacles 225' within shell half 221'. Wiring harness 211 is fed through harness port 209 as this process takes place. Then, shell half 221" is moved along the direction of arrows A" such that the support receptacles 225" are fitted over support locks 205. Once mated, the two shell halves 221' and 221" may be "snapped" together to complete the fully assembled ornament.

Figure 4:
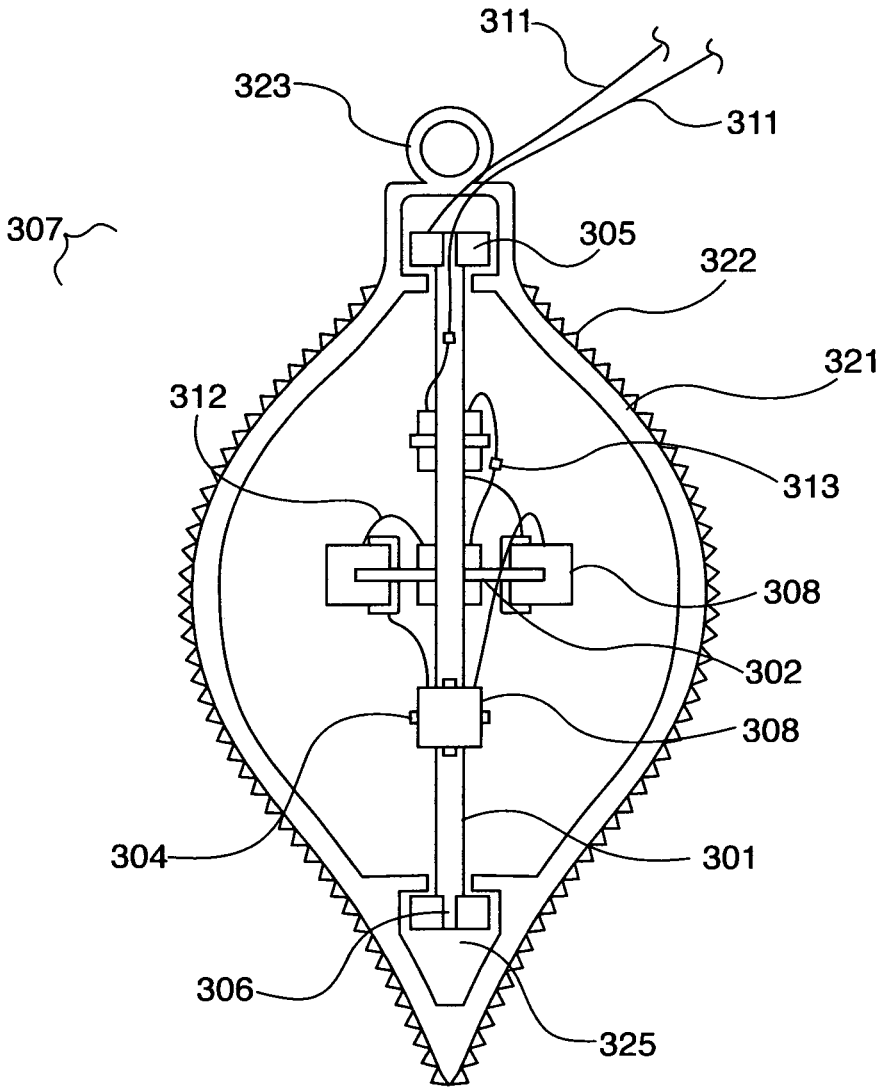
FIG. 4 shows cutaway side view of a lighted ornament according to another embodiment of the present invention.

FIG. 4 shows a cutaway side view of a tear drop shaped ornament 307 displaying the teachings of the present invention. In one subassembly embodiment, the different ornament geometry presented in FIG. 4 may be accommodated by the exact same support piece 1 provided in FIG. 1, assuming that the end-to-end lengths of the ornaments are uniform. Also, due to differences in ornament geometry, the placement of LEDs may desirably be altered to achieve optimal illumination within any particular ornament. In a fixed subassembly, support 301 would simply be molded to provide the secondary supports 302 and/or the directly fixed LED mounts 303/304 at the desired locations along support 1. In a flexible subassembly, assuming the same length as in the ornament of FIG. 1, the secondary supports may be added as needed and/or slid into the desired locations. Again, support 301 is secured within the ornament along a central axis of the ornament and is secured therein by two receptacles 325 disposed on opposite ends of the ornament. While the support locks 305 on support 301 may be the same among different ornaments, different receptacle geometries 325 may be necessitated by any one particular shell design. Further, for manufacturing and assembly purposes, the mounting locks may be keyed to the receptacles such that certain subassemblies only work within certain ornaments.

Figure 5:
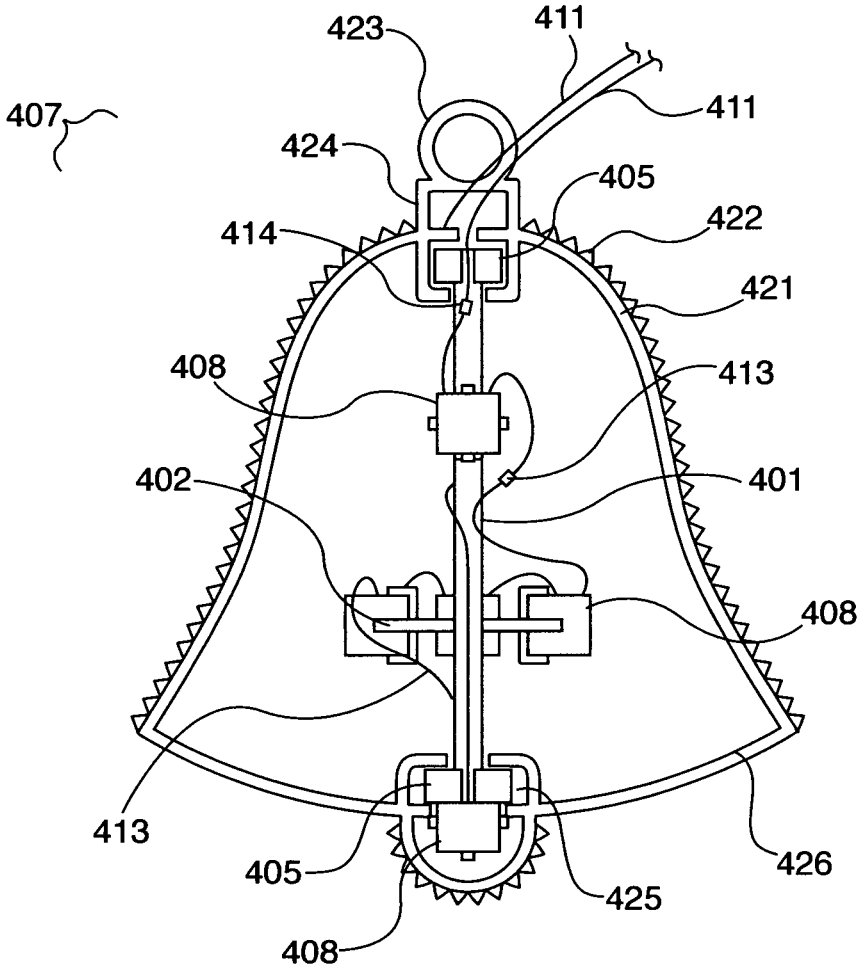
FIG. 5 shows cutaway side view of a lighted ornament according to another embodiment of the present invention.

FIG. 5 shows a cutaway side view of a bell-shaped ornament 407 displaying the teachings of the present invention. All elements of FIG. 5 are numbered correspondingly as with those in the preceding figures. Of particular note are the placement of one LED in the "clapper" portion of the bell for specific illumination of that ornament element, and the placement of the three LEDs at the lower one-third point on the support 401 and the single LED at the upper one-third point on the support 401. Apart from the specific illumination of the clapper, the other axial placement locations are selected so as to provide proper illumination to the ornament when lit.

Figure 6:
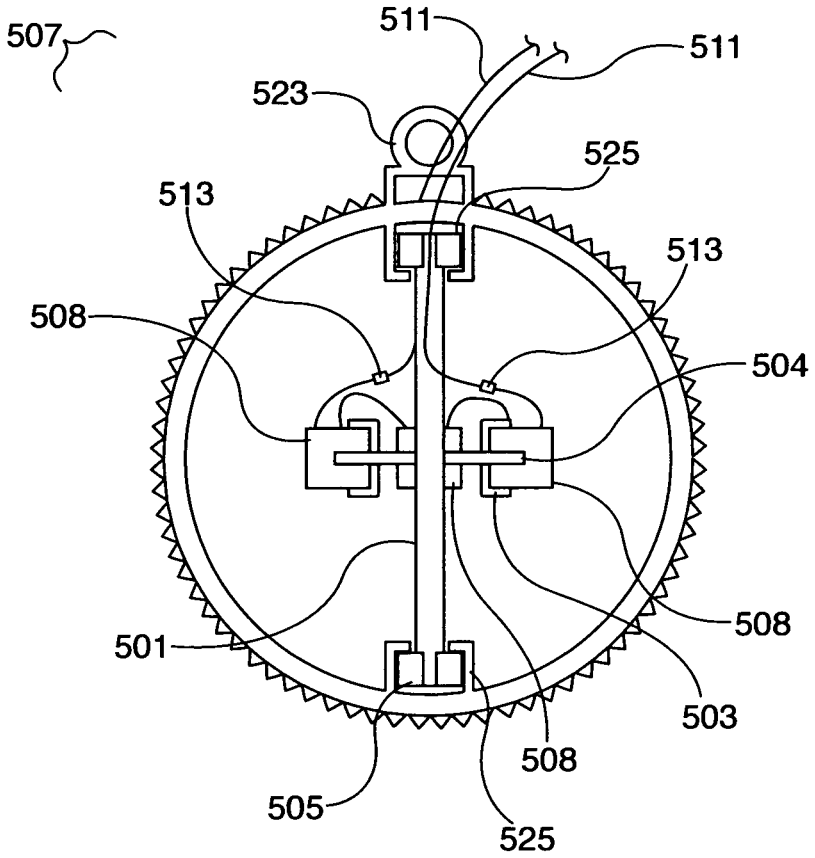
FIG. 6 shows cutaway side view of a lighted ornament according to another embodiment of the present invention.

Although not specifically stated, it has been assumed that the LEDs in FIGS. 1-5 are all of the same color. In fact, LED illumination elements have a very high lumens-per-watt rating as compared to other types of lights, including incandescent lights. Thus, depending on the ornament size, it may be that only one LED bulb is necessary to properly illuminate any of the previously disclosed ornaments, particularly when centered properly in the ornament. In this case, the use of supports to mount multiple LEDs of different colors is particularly advantageous. For example, a support containing 3, 4, or 5 LED mounts would allow a clear-shelled ornament to have the ability to adopt any one of a number of colors. Each of FIGS. 1-5 has shown five LEDs mounted within the ornament. FIG. 6 shows a smaller version of the spherical ornament 507 provided in FIG. 1 with only three LEDs 508. Given the reduced size of the ornament, only one LED is likely needed to provide any one illumination color. Alternatively, the additional LEDs may be of the same single color so as to provide a "redundant" lighting capability so as to prolong the expected useful life of the ornament. It should be appreciated that the control of the lighting within the ornament with respect to any multi-LED arrangement is accomplished via LED power and control signals within the wiring harness.

FIG. 7 shows a tree-top lighted ornament having three separate, but unitarily connected, globes of varying sizes. Ornamental shells and pointed top 621 are separately illuminated from within and may be clear or opaque. If opaque, shells 621 may be frosted any one of a number of colors including different colors as between them on the same ornament. Painted surfaces 629 join the shell portions and form the conical receptacle 609 for accepting the tree top on which the ornament is mounted.

FIG. 8 shows a cutaway side view of the ornament of FIG. 7 Four separate LED support subassemblies (717"", 717"', 717", 717') are provided as part of the support structure within the tree top ornament. All other elements of FIG. 8 are numbered correspondingly as with those in the preceding figures. As mentioned above, the separate subassemblies required to construct tree top ornament 707 may be manufactured as one single unit or they may be separately created and assembled specifically for this decoration. In this manner, almost any ornament of any geometry can be constructed if appropriate options for customization are provided within a "standard support" manufacturing package. In essence, the construction of highly customizable holiday ornaments may be made in a manner similar to that in which a child uses building blocks like Legos® or Tinker Toys™. As shown in FIG. 8, two support receptacles 725 are shown that provide an overall mechanical structural registration of the support subassemblies within the outer shell 721. Light blocking surfaces 716 may be used to isolate the light created within any subsection. Simple reflective paint may be used to accomplish this. Male or female connector plug 734 is coupled to the wiring harness 711 to provide a standard connection to power and control signals made available by the centralized provisioning structures within an LED lighting system.

Figure 9:
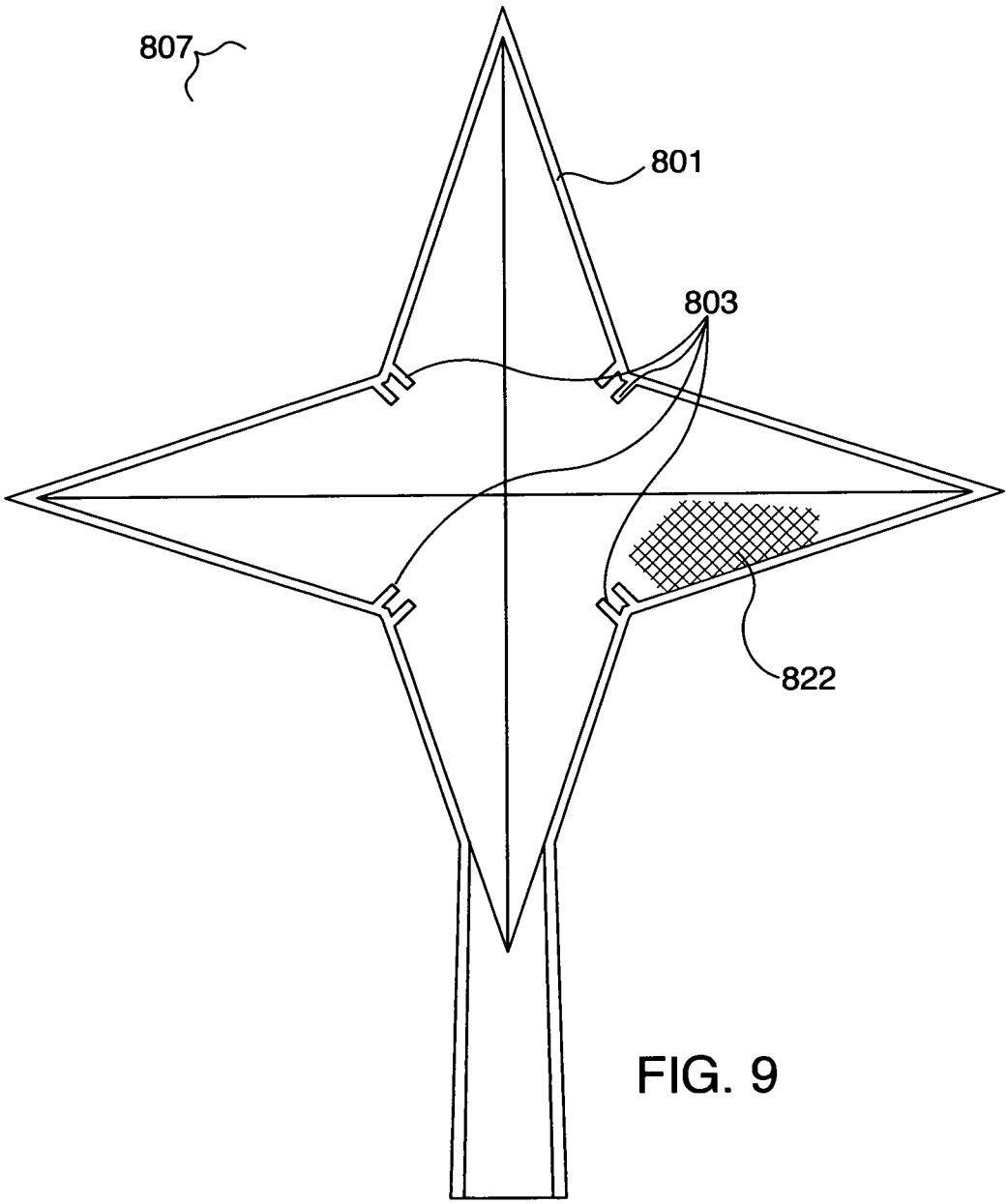
FIG. 9 shows cutaway side view of a lighted ornament according to another embodiment of the present invention.
Figure 10:
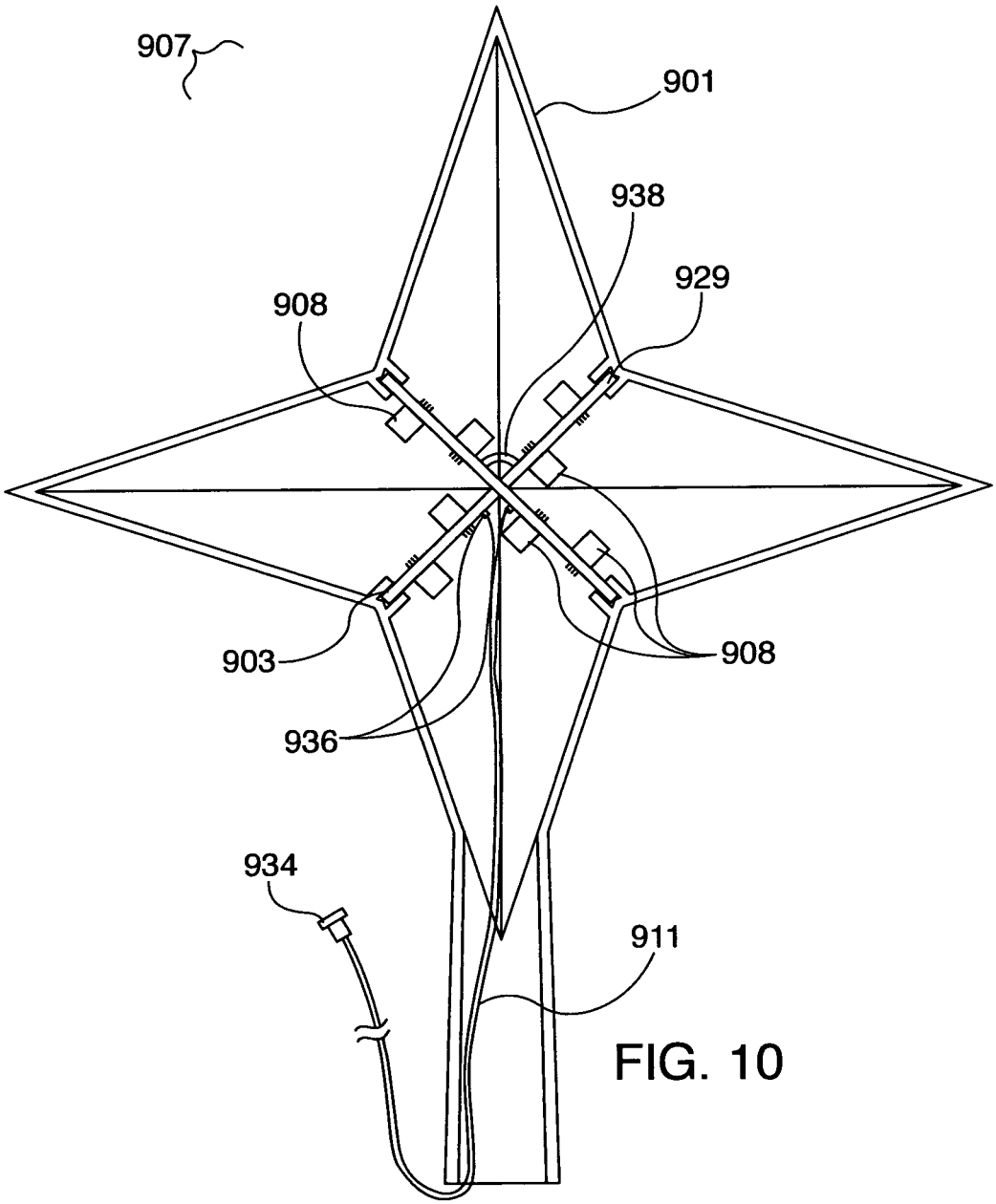
FIG. 10 shows cutaway side view of the ornament of FIG. 9 with additional lighting elements included.
Figure 11A:
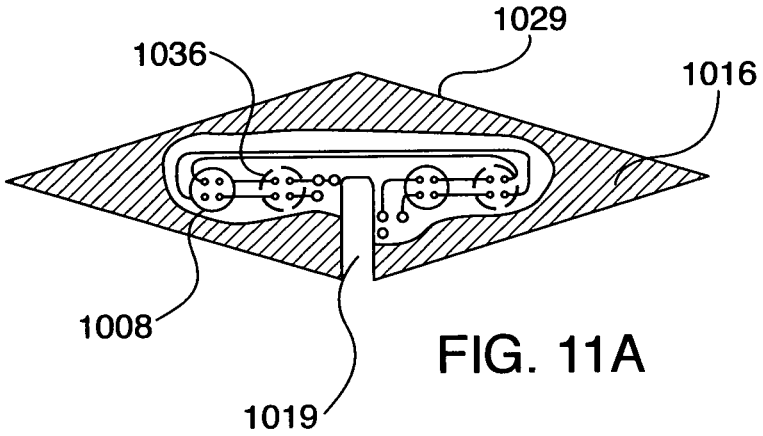
FIGS. 11A and 11B show a subassembly of the inner support structures used within the ornament of FIGS. 9 & 10 according to one embodiment of the present invention.

FIG. 9 shows a star-shaped tree-top lighted ornament 807. Outer support casing 801 is shown in cutaway cross section as a star pattern having four LED mounting supports 803. Jagged surface 822 may be provided on the exterior surface for of the lighted ornament 807 to enhance the optical characteristics of the ornament. Referring to FIG. 10, two sided printed wiring board (PWB) 929 is shown in an edge view and held in the ornament with LED mounts 903. PWB 929 contains LEDs 908 on both sides of the PWB. A second PWB is aligned perpendicular to the first and is situated in corresponding LED mounts 903. LED power and control signals are provided to the ornament 907 from connector 934 and delivered to the PWBs via wiring harness 911 which is connected to the PWB with connectors 930 at PWB connectors 936 (1036 as shown in FIG. 11A). Inter-PWB connections may be permitted with jumper connectors 938.

Figure 11B:
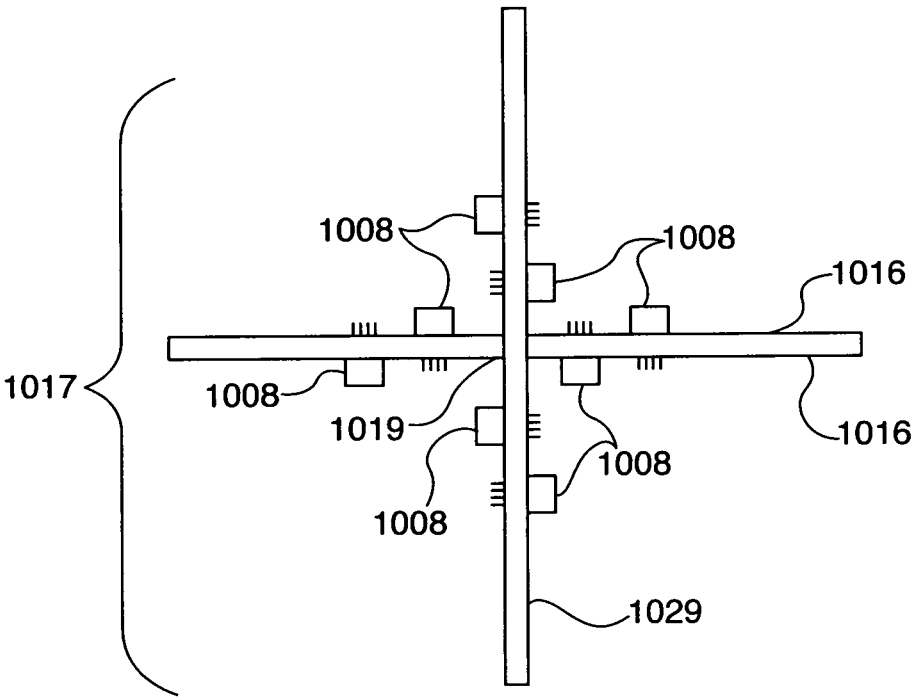

FIG. 11A shows a front view of the PWB 1029 containing silver coating 1016, PWB interconnection slot 1019, PWB connector 1036 for connection to wiring harness connector 930 and LEDs 1008. As with all other designs within the scope of this invention, LEDs. 1008 may any one or more of single color, dual color, multicolor or different combinations and permutations of the same anywhere on the wiring boards. FIG. 11B shows the LED support subassembly 1017 with the two PWBs connected in "dove-tail" fashion through the use of interconnection slots 1019.

Figure 12:
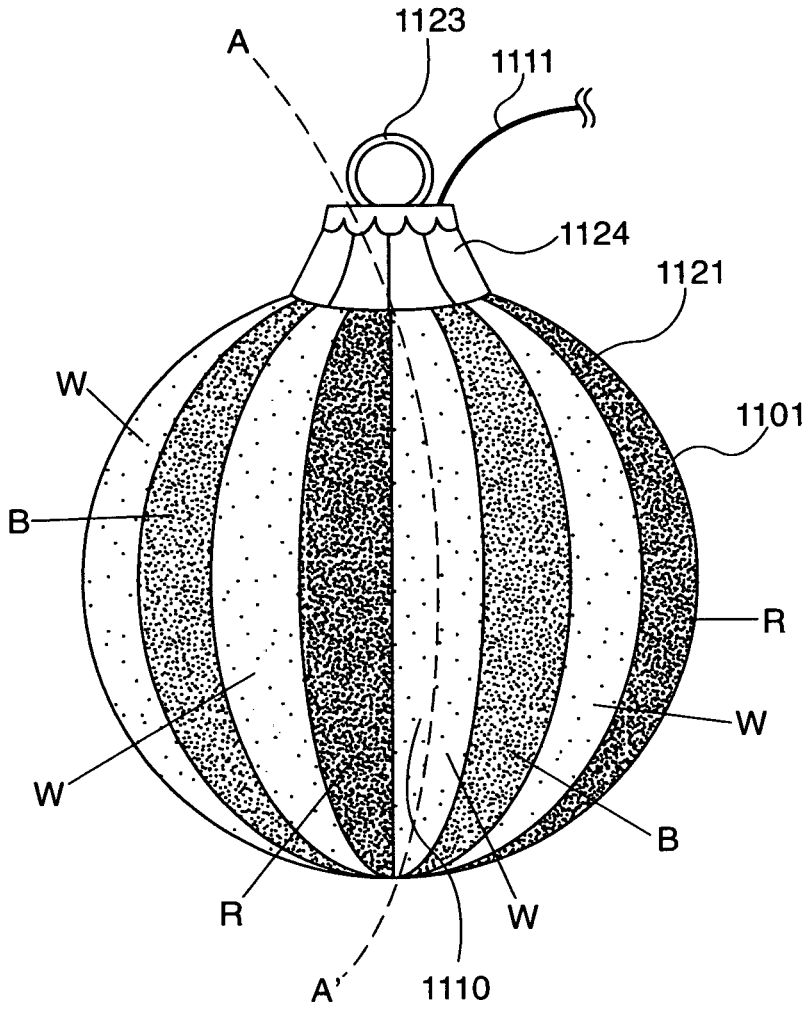
FIG. 12 shows a lighted ornament according to another embodiment of the present invention.

FIG. 12 shows a red-white-and-blue colored, medium-to-large LED illuminated ornament as an example of one of several specific holiday color combinations. The ornament has a shell or case 1101, hanger cap 1124 having a hanger 1123. The displayed colors created by the LEDs within the ornament are provided on a sectional basis, vertically arranged, with each segment/stripe/section 1110 displaying a single different color at any one instant in time. Over time, each segment may display a static color in that segment (using single color LEDs) or may display a plurality of colors (using multi-colored LEDs within the segment). In either case, the color display of the LEDs may be accomplished with the assistance of a controller so as to create the appearance of a moving multicolor display and impart perceived motion to the ornament. It should be appreciated that by specifying that "one color" is displayed at an instant in time, it is meant that a certain LED or groups of LEDs are on within the segment to create that desired color. For example, if there are Blue, Red and White LEDs within a segment, BLUE can be emitted by illuminating only the Blue LEDs, RED can be emitted by illuminating only Red LEDs, PINK can be emitted by illuminating RED and WHITE LEDs, PURPLE can be emitted by illuminating the RED AND BLUE LEDs, etc. The LED lighting controller to which the ornament is coupled via the wire harness 1111 provides the signaling to accomplish all lighting functions. Alternatively, and as with the embodiments of FIGS. 1-11, wireless receivers may be embedded on any printed circuit boards or other apparatus within the ornaments so as to effect wireless signal control of the LED and the ornament illumination without the aid of the wire harness.

Figure 13:
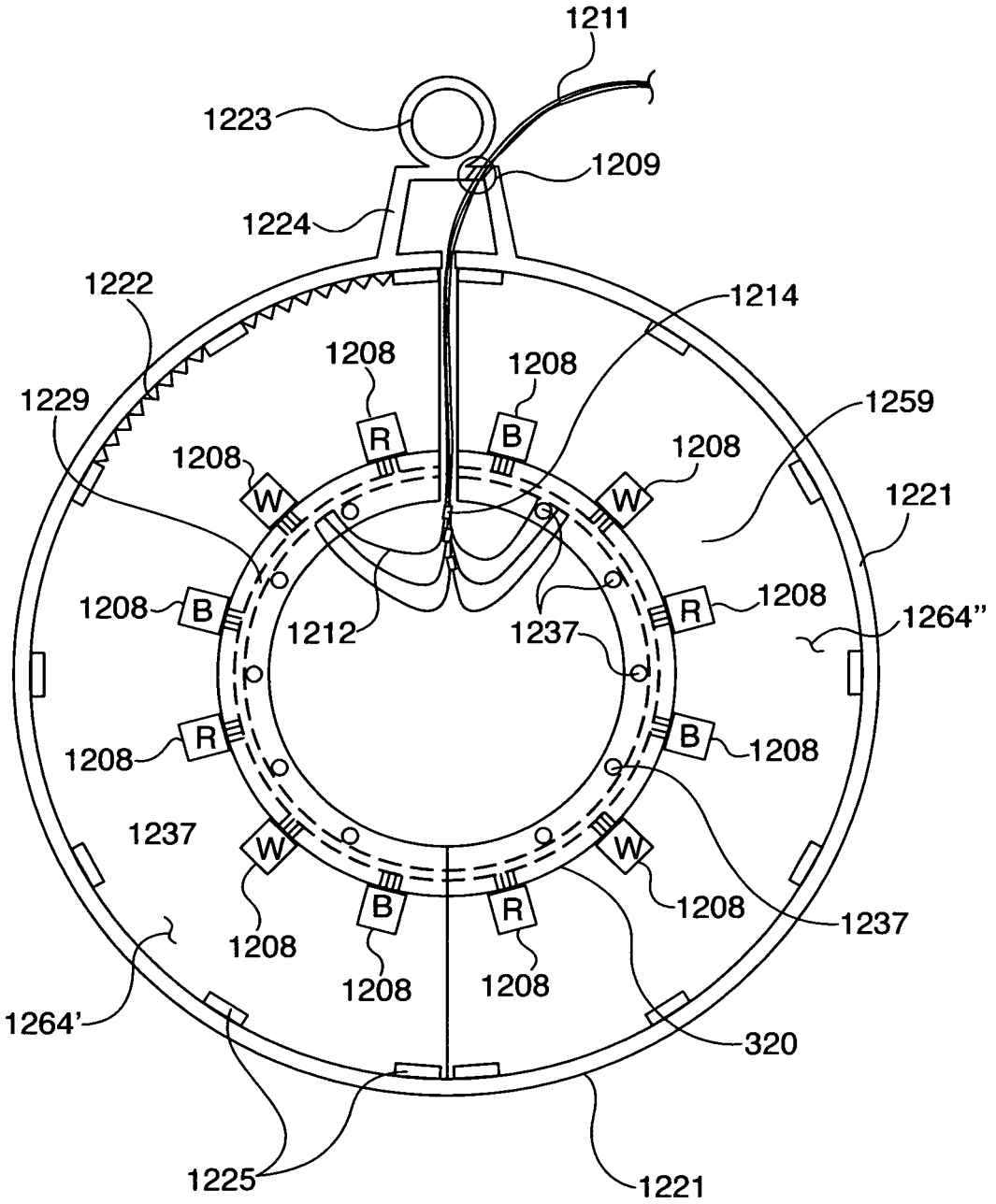
FIG. 13 shows a cross-sectional view of the ornament of FIG. 12 taken in the middle of a section.

FIG. 13 shows cross sectional side view one half of an LED illuminated ball ornament of FIG. 12. The section is taken through the middle of one of ornament segments 1110 along segment line A-A' shown in FIG. 12. The interior surface 1222 of ornament shell 1221 is coated with a light diffusing material. This is provided to enhance the display of the light exiting the ornament by smoothing the otherwise bright, reflected light generated within illumination volume 1259. Illumination volume 1259 is the volume contained by one of the ornament segments 1110 and within which one color of light is generated for display at any one point in time by LEDS 1208. Hanger 1223 is attached to hanger cap 1234 which is itself affixed to the outer surface of ornament case 1221. Hanger cap has a wire harness access port 1209 for allowing wire harness 1211 to exit from the ornament interior through the ornament shell 1221 to the outside for external connection to power and control signaling. Segment separators 1264 divide each of the segments 1110 from one another within the ornament volume. FIG. 13 shows the flat, inner surface of the two segment separators 1264' and 1264" that bound the opposite side of the ornament segment 1110 through which the cross section was taken. Two segment separators per plane are used so as to avoid the need for any interlocking dove-tail configurations within the ornament itself. Segment separators are held in vertical fixed relation to the ornament shell by tabs 1225 which extend from the shell inner surface into the inner volume of the ornament. A plurality of tabs form a ring around the vertical circumference of the ornament, one on each side of the segment separator so that the two segment separators defining each separator plane of the ornament remain in fixed relationship. Although the two segment separators 1264' and 1264" are shown as planar in FIG. 13, nothing precludes an ornamental design in which non-planer, hemi-spherical planes are inserted around the circumference of the ornament.

Figure 14A:
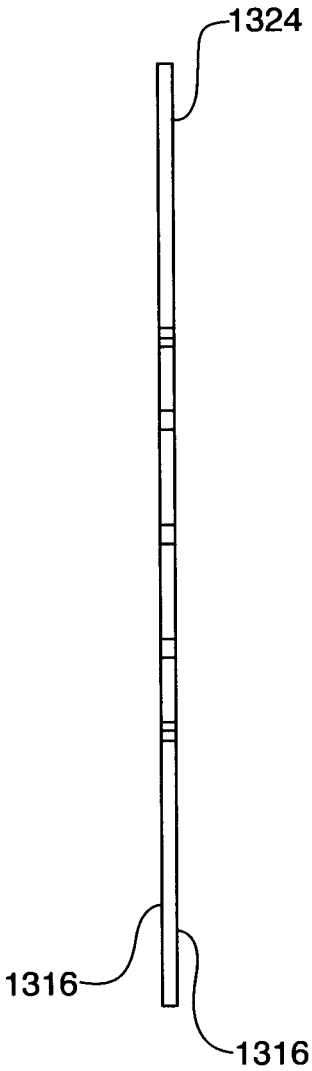
FIGS. 14A and 14B show an edge view and side view respectively of a vertical segment separator for a lighted ornament according to one embodiment of the invention.
Figure 14B:
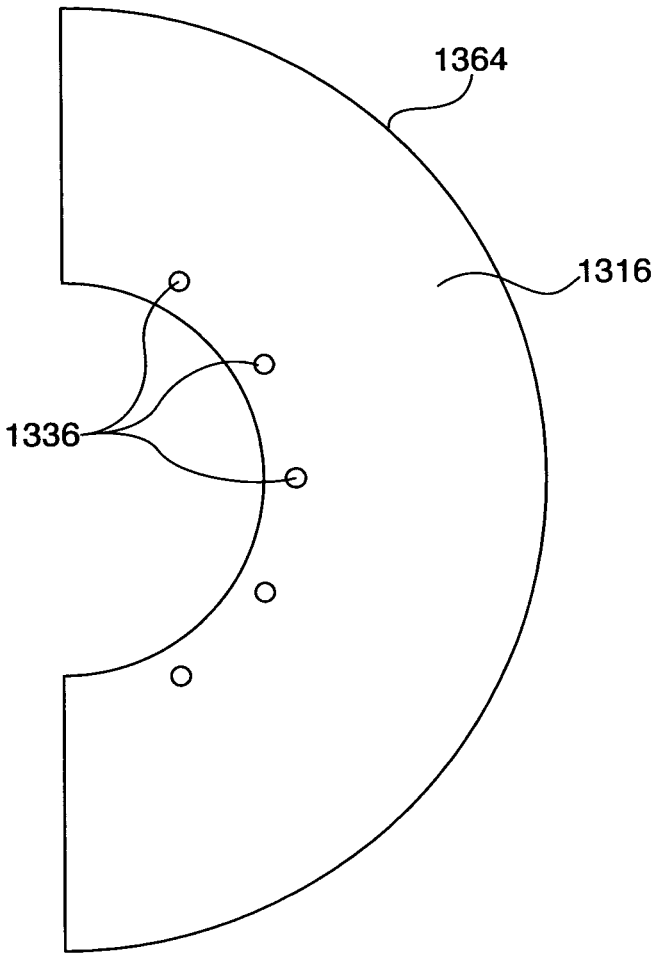
Figure 15A:
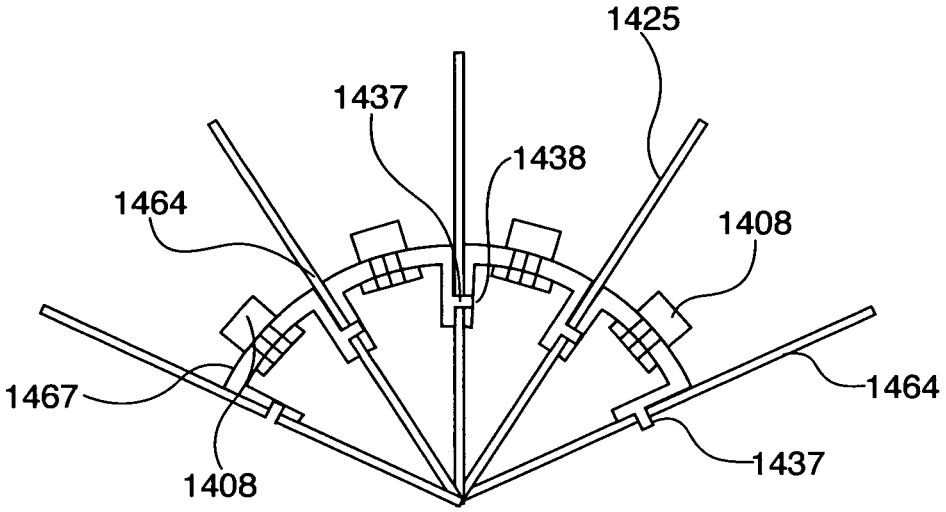
FIGS. 15A and 15B show partial assembly diagrams containing two embodiments of the LED segment bases according to the present invention.
Figure 15B:
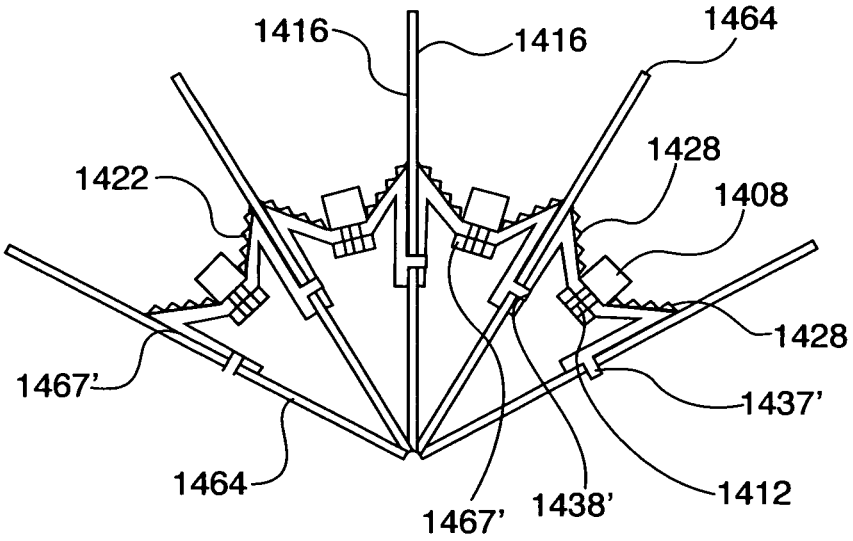

FIGS. 14A and 14B show edge views and side views respectively of the semi-circular segment separator 1364 having reflective coating 1316 on the surface thereof. Segment separator locking holes 1336 are provided for fixably mounting the segment separator within the ornament volume and onto segment separator pins 1237 of FIG. 13. FIGS. 15A and 15B show a plurality of segment separators connected side-to side along with interspersed segment base sections 1467. These pieces interlock through a "snap" type pin and hole registration. When the manufacturing tolerances of all the ornament component piece parts are precise enough and tight enough, i.e. the tabs, segment separators, segment bases and the overall ornament dimensions, the "snap" function may omitted and the ornament may conceivably be held together after simple assembly and proper registration of all holes and pins. In either case, LED segment bases 1467 contain, on one side of the base, the LED segment pin 1437, and in the same registered position on the other side, a LED segment hole 1438. The segment separators 1464 have holes 1336 positioned in the same location.

Figure 17:
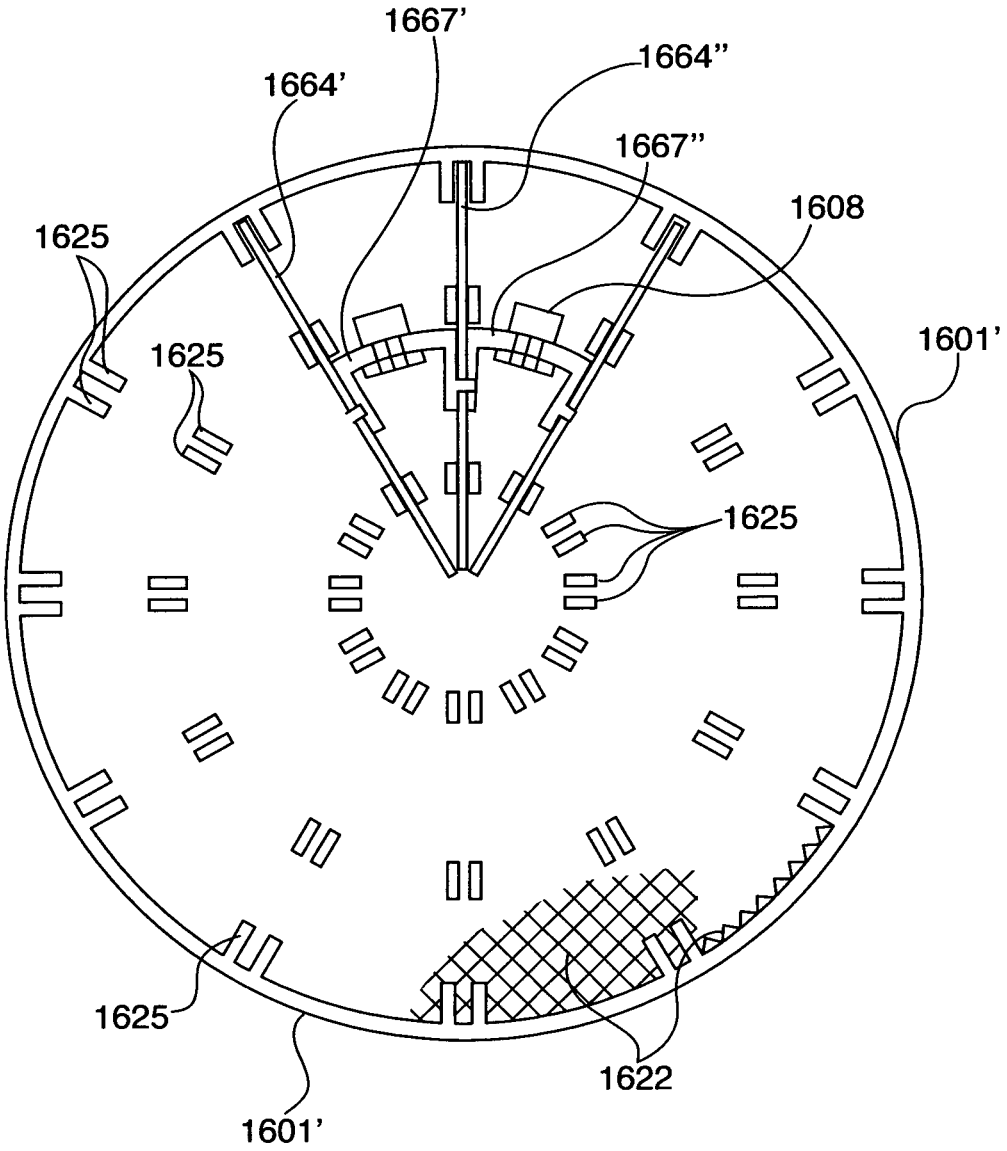
FIG. 17 shows a top view of the ornament bottom with a partial assembly of the inner parts according to one embodiment of the invention.

FIG. 17 shows a top-down view of the ornament bottom half with two LED segment bases and three segment separators assembled. In this figure, the internal surface of the ornament is shown as being coated with light diffusion material 1622.

Within each segment, a structurally supporting LED segment base 1567 of FIGS. 16A-D is provided on which that segment's PC board is mounted. Each segment base has a female receptacle 1538 on one of its mounting sides that is disposed, once connected, against the segment separator 1664 (which is on the left side in the figures provided) and a male pin that is disposed on the other of its mounting sides, once connected, against the opposite segment separator (which is on the right side in the figures provided). Male pins are aligned with the segment separator holes such that the male pin from one segment base protrudes through the segment separator hole 523 and seats within the segment base receptacle of the adjacent segment base. In this manner, the entire structure is built, segment-by-segment, until the internal portions of the ornament meet together again.

As shown in FIG. 17, to assemble the ornament, the bottom half of the ornament shell 1601' is placed on a surface. Segment separator 1664' is placed into the base with the outer semicircular edge facing the inside surface of the shell base. Tabs 1625 assist with the proper placement of the segment separators which are pushed between the tabs and slotted into place. LED segment base 1667' is then placed in the base to the right of segment separator 1664' with segment separator hole 1636' being aligned with LED segment base hole 1638'. Second segment separator 1664" is then inserted with the LED base segment pin1637' of LED base segment 1667' placed in the segment separator hole 1636" of the second segment separator. Second LED segment base 1667" is then placed in the shell and second LED segment base hole 1638" is "snapped" onto, or at least registered with first LED segment base pin 1637' as it extends through second segment separator 1664". This process continues until the inside of the ornament is entirely populated.

Figure 16A:
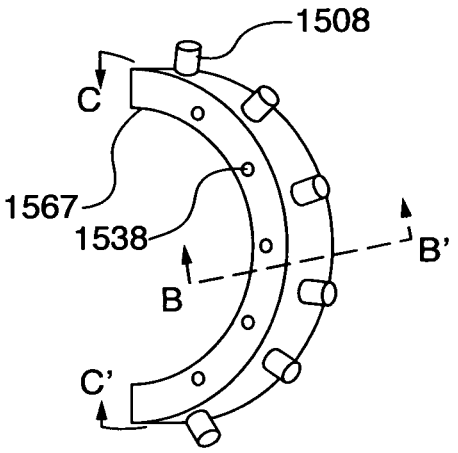
FIGS. 16A-16D show various views of an LED segment base according to one embodiment of the invention.
Figure 16B:
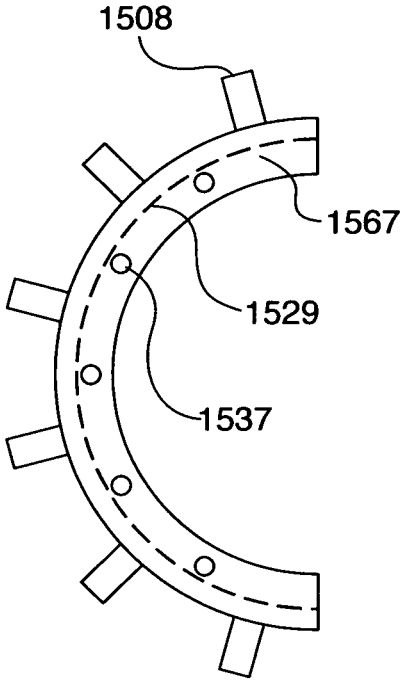
Figure 16C:
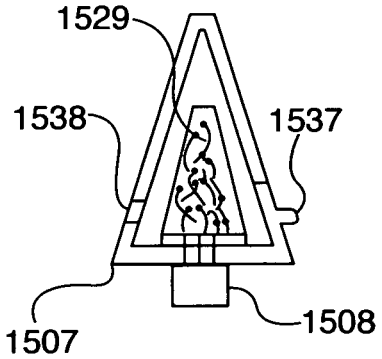

With respect to FIGS. 16A-D, FIG. 16A shows an orthogonal view of the LED segment base 1567 having LEDs 1508 and LED base segment pins 1537. FIG. 16B is a right side view of the same LED segment base. FIG. 16C is a cross sectional view of the same LED segment base taken at cross section B-B' shown in FIG. 16A. FIG. 16 D is a cross section of the LED segment base taken along C-C' as shown in FIG. 1A.

Figure 16D:
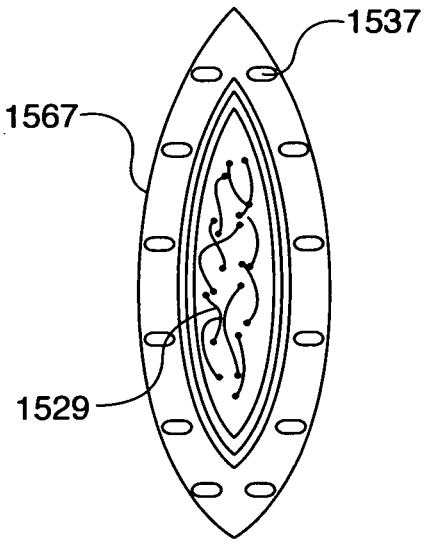

Referring to FIGS. 13 & 16B, flexible PC board 1229 & 1529 is shown as a dotted line within the LED base segment bisected in the figure. PC board 1529 contains the electronic circuitry that is required to connect to the wires 1212 within the wiring harness 1211 and LEDs, 1208 & 1508. In this regard, wiring bus 1211 is separated into individual control and power signaling wires 1212 within the inner portion of the ornament, behind the LED segment base. These wires terminate at a connector which are connected to connectors 1237 that are part of the PC board 1229 & 1529 within each LED segment base. Certain aspects of the PC board are also shown at FIGS. 16C and 16D. PC board 1229 functions similarly to PWB 929 described in connection with 10. Printed circuit board 1229 is a semi annular board that mounts to both adjoining segment separators as described below within each segment. Printed circuit board (PCB) contains a plurality of LEDs along the arc of the PCB, the PCB electrically couples the LEDs to external power through wire harness 1211 via connector 1237.

Referring to FIG. 15B, an alternative LED base segment embodiment is shown in which recessed LED base segments 1467' are used ("M" shaped) where the two inward angled portions are silvered and Fresnel grooved 1528 to cause the LED illumination to be magnified outward from the segment and into the interior of the ornament and on to the outside of the ornament.

Figure 18:
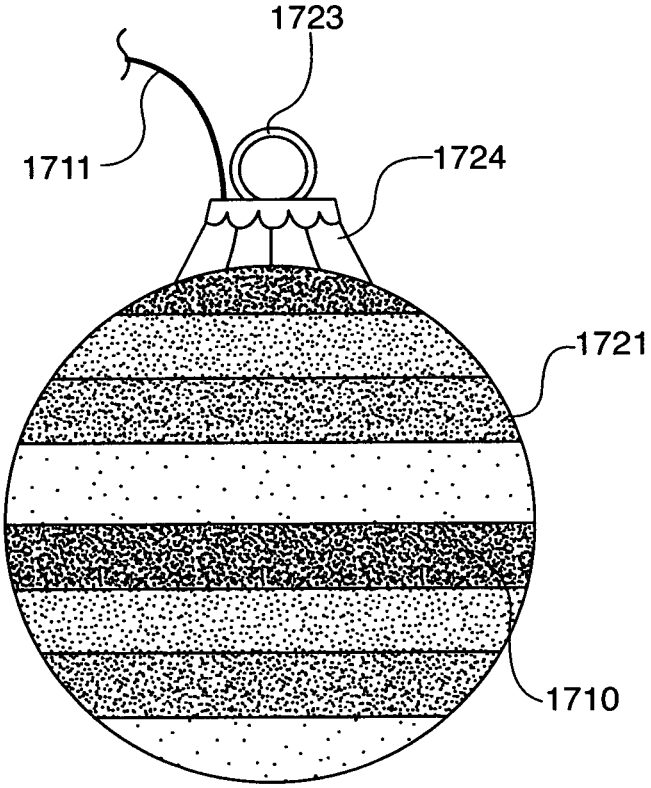
FIG. 18 shows a lighted ornament according to another embodiment of the present invention.
Figure 19:
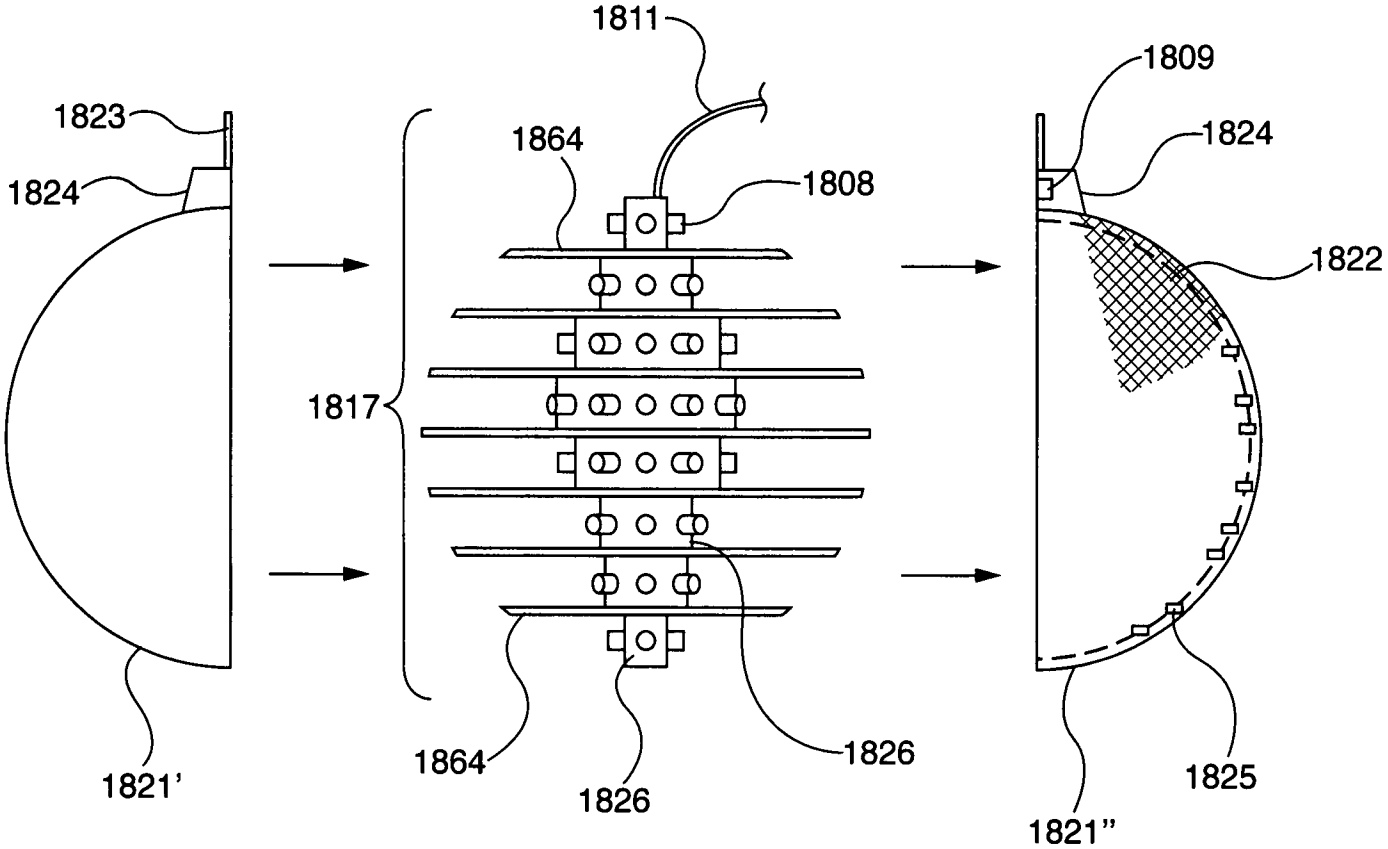
FIG. 19 shows an exploded view of the lighted ornament of FIG. 18.

FIG. 18 shows another embodiment of the lighted ornament of the present invention in which the ornament is divided horizontally into horizontal sections 1710. The construction of this embodiment is considerably more simple then that of the vertical structure as shown in FIG. 19. In FIG. 19, right and left ornament shell halves 1821' and 1821" are fitted around an LED mounting assembly 1817. Led mounting assembly 1817 contains horizontal segment separators 1864 of varying diameter to match their position within the ornament. Horizontal segment separators are inserted at their edge into separator tabs 1825 that support and keep the separators in proper registration within the ornament. LED segment bases 1826 are affixed to one another through the horizontal section separators in much the same way as with the vertical design. LED segment bases are of varying diameter to create a common distance from the LEDs 1808 to the inner surface of the ornament shell 1831 so as to provide uniform illumination when viewed from the exterior. Wiring harness 1811 connects to each of the LED segment bases and the LEDs thereon to control and power the LED.

While the invention has been shown and described with reference to specific preferred embodiments, it should be understood by those skilled in the art that various changes in form and detail may be made therein without departing from the spirit and scope of the invention as defined by the following claims.

What is claimed is:

1. An ornament comprising:

a housing having an inner surface and an outer surface;

a plurality of segment separators disposed within the ornament and dividing a cavity of the ornament into a plurality of separate regions separated by the plurality of segment separators; and a plurality of base sections disposed perpendicularly to the plurality of segment separators;

wherein a plurality of lighting elements are mounted on the plurality of base sections;

wherein the plurality of lighting elements are coupled to each other and to a wiring harness;

wherein the wiring harness extends at least to outside of the housing; and wherein the plurality of segment separators extends from a central portion of the ornament to the inner surface, and the plurality of base sections extends circumferentially about a central portion of the ornament.

2. The ornament of claim 1, wherein each segment separator is coupled to a lighting element, each of said lighting elements containing at least two LEDs having different colors.

3. The ornament of claim 1, wherein each of the plurality of base sections is coupled to a lighting element, each of said lighting elements including at least one LED.

4. The ornament of claim 1, wherein each of the plurality of base sections is attached to a central portion of each of two adjacent segment separators.

5. The ornament of claim 4, wherein each of the plurality of lighting elements is disposed facing the inner surface in one of the plurality of separate regions.

6. An ornament comprising:

a housing having an inner surface and an outer surface;

at least two support receptacles disposed on the inner surface; and a support column having end portions sized to fit within the at least two support receptacles, the end portions inserted into the at least two support receptacles such that the support column is mountably engaged in a fixed position within the ornament;

wherein the support column includes a plurality of mounting brackets each configured to snappably mount one of a plurality of lighting elements within the ornament;

wherein the plurality of lighting elements are coupled to each other and to a wiring harness; and wherein each of the plurality of mounting brackets includes a vertical mounting member and a horizontal mounting member configured to snappably mount one of the plurality of lighting elements.

7. The ornament of claim 6, wherein each of the plurality of mounting brackets is slidably disposed on the support column.

8. The ornament of claim 6, wherein the inner surface is coated with a coating, the coating being selected from the group consisting of a reflective coating and a light diffusing coating.

* * * * *